US009779598B2

(12) United States Patent
DiPoala

(10) Patent No.: US 9,779,598 B2
(45) Date of Patent: Oct. 3, 2017

(54) SECURITY SYSTEM INCLUDING LESS THAN LETHAL DETERRENT

(75) Inventor: William DiPoala, Fairport, NY (US)

(73) Assignee: Robert Bosch GmbH, Stuttgart (DE)

( * ) Notice: Subject to any disclaimer, the term of this patent is extended or adjusted under 35 U.S.C. 154(b) by 2765 days.

(21) Appl. No.: 12/331,680

(22) Filed: Dec. 10, 2008

(65) Prior Publication Data

US 2010/0128123 A1 May 27, 2010

Related U.S. Application Data

(63) Continuation-in-part of application No. 12/275,499, filed on Nov. 21, 2008, now Pat. No. 8,525,880.

(51) Int. Cl.
*G08B 13/196* (2006.01)
*G08B 15/02* (2006.01)

(52) U.S. Cl.
CPC . *G08B 13/19691* (2013.01); *G08B 13/19619* (2013.01); *G08B 13/19697* (2013.01); *G08B 15/02* (2013.01)

(58) Field of Classification Search
CPC ..... H04N 7/183; H04N 7/188; H04N 5/225; H04N 5/2252; H04N 17/002; H04N 21/4223
USPC ..... 348/143, 154
See application file for complete search history.

(56) References Cited

U.S. PATENT DOCUMENTS 5,182,541 A 1/1993 Bajorek et al.
5,394,139 A 2/1995 Dards
5,402,000 A 3/1995 Owens, II
5,819,124 A 10/1998 Somner et al.
6,094,135 A 7/2000 Sugimoto et al.
6,504,479 B1 * 1/2003 Lemons et al. ..... 340/541
6,762,686 B1 * 7/2004 Tabe ..... 340/573.1
7,388,485 B1 * 6/2008 Shen ..... 340/541
7,710,452 B1 * 5/2010 Lindberg ..... 348/149
2005/0124234 A1 * 6/2005 Sells et al. ..... 440/33
2006/0086348 A1 4/2006 Song et al.
2007/0109407 A1 * 5/2007 Thompson ..... 348/143
2008/0074256 A1 * 3/2008 Hirai et al. ..... 340/541
2008/0111687 A1 * 5/2008 Husmann ..... 340/552
2008/0231705 A1 * 9/2008 Keller et al. ..... 348/154
(Continued)

FOREIGN PATENT DOCUMENTS

WO WO 0108478 A1 * 2/2001

OTHER PUBLICATIONS

Song et al.; "Surveillance Tracking System Using Passive Infrared Motion Sensors in Wireless Sensor Network"; Jan. 23-25, 2008; International Conference on Information Networking, 2008 (ICOIN 2008).*

(Continued)

*Primary Examiner* — Jeffrey R Swearingen
(74) *Attorney, Agent, or Firm* — Michael Best & Friedrich LLP

(57) ABSTRACT

A security system includes a video system for capturing images of an intruder. A deterrent dispensing device dispenses a deterrent substance in a selected direction. An actuator module is communicatively coupled to the video system and is coupled to the deterrent dispensing device. The actuator module receives a video signal from the video system and, in response thereto, controls the deterrent dispensing device to thereby aim the dispensed deterrent substance in a direction of the intruder.

16 Claims, 15 Drawing Sheets

(56) References Cited

U.S. PATENT DOCUMENTS

| | | | | |
|---|---|---|---|---|
| 2008/0252722 | A1* | 10/2008 | Wang et al. | 348/143 |
| 2009/0122143 | A1* | 5/2009 | Latham et al. | 348/155 |
| 2010/0238019 | A1* | 9/2010 | Richman et al. | 340/521 |

OTHER PUBLICATIONS

Bai et al.; "Enhancement of the sensing distance of an embedded surveillance system with video streaming recording triggered by an infrared sensor circuit"; Aug. 20-22, 2008; SICE Annual Conference, 2008.*

Greg Kogut et al.; ("A Vision System for an Unmanned, Non-lethal Weapon") Intelligent Robots and Computer Vision XXII, Philadelphia, PA, Oct. 25-27, 2004.*

D.A. Ciccimaro et al.; "An automated security response robot"; SPAWAR Systems Center; publication 1998.*

Burnt Popcorn; "Defcon Bot";found at: http://www.burntpopcorn.net/defcon_bot/; Jun. 30, 2007.*

Rojas. "The Smell Cannon". Engadget. Apr. 2, 2004. Retrieved from http://www.engadget.com/2004/04/02/the-smell-cannon/ on Apr. 27, 2015.*

"The Sentry Project", retrieved from http://web.archive.org/web/20080801162124/http://www.paintballsentry.com/history.html on Apr. 27, 2015.*

* cited by examiner

SECURITY SYSTEM INCLUDING LESS THAN LETHAL DETERRENT

RELATED APPLICATION

The present application is a continuation-in-part of U.S. patent application Ser. No. 12/275,499, titled "SECURITY SYSTEM INCLUDING MODULAR RING HOUSING," filed Nov. 21, 2008, which is incorporated by reference herein in its entirety.

BACKGROUND OF THE INVENTION

1. Field of the Invention

The present invention relates to security systems, and, more particularly, to security systems that are capable of deterring an intruder.

2. Description of the Related Art

Security systems are commonly used by retail stores, banks, casinos and other organizations to monitor activities within a given area. A typical small commercial building has several independent systems installed to provide various functions. For example, a building may include a fire alarm system, burglar alarm system, intercom system, video security system, background music system, and/or an emergency lighting system, which are all independent systems.

The control stations and system devices are spread throughout the building at various locations. It is common to see several of the different system devices next to each other. This requires multiple wiring systems to be run. This adds cost to the building owner since the systems are usually installed by different contractors. This also results in a hodgepodge look to the building since the wall or ceiling is cluttered with devices having different appearances.

Typical security systems are constructed as a single unit. When any portion of the security system is faulty, the entire unit must be removed from a mounted arrangement and returned to the manufacturer. Such a unitary configuration hampers the ability to make field repairs of existing units and causes a number of warranty return problems.

The unitary construction of the typical security system prevents easy reconfiguration, upgrading, and maintenance of existing units. When individual components in the system need to be upgraded or replaced, the entire unit must be removed and replaced with a new unit. This requirement of replacing the entire system whenever an individual component thereof needs to be replaced or upgraded adds to the cost and complexity of maintaining, upgrading and/or reconfiguring the security system.

Known security systems are useful primarily in notifying police and system owners that a burglary is taking place. The burglar is well aware that once an alarm system is triggered, he has adequate time to carry out the burglary before the police arrive.

Another problem with known security systems is that they can produce false alarms due to a number of sources, but primarily caused by the premises owner. The owner often forgets that the alarm system is armed and does not disarm the alarm system before opening a door. Other sources of false alarms include friends and household laborers who may have access to the premises but who are either not aware of, or forget about, the armed security system. False alarms may also be caused by a number of environmental conditions, including lightning strikes, power line transients, and thermal changes. Another source of false alarms is rodents, which can trigger motion detectors.

Security systems are known to include less than lethal deterrents (LTLD), such as nets to catch an intruder; spraying paint, dye or fluorescent powder onto an intruder; or spraying an irritant liquid onto the intruder. However, if a false alarm activates the LTLD, then, at best, the deterrent will need to be removed from the premises. At worst, the deterrent will have been used against an innocent party, and the premises may be damaged by the deterrent. In either case, the false alarm may result in the LTLD system having to be reloaded, which can be expensive and time consuming.

What is neither disclosed nor suggested by the prior art is a security system that does not need to be replaced as a unit whenever an individual component of the system needs to be reconfigured, replaced, or upgraded. What is also neither disclosed nor suggested by the prior art is a security system that enables multiple independent systems to be compactly and aesthetically installed in a same housing. Nor does the prior art disclose or suggest a security system that verifies that the source of an alarm signal is an intruder, and that then efficiently and effectively deters the intruder from completing an act of burglary.

SUMMARY OF THE INVENTION

The present invention provides a security system that incorporates a less than lethal deterrent (LTLD) to force a burglar or other intruder out of the premises or to incapacitate the intruder until police arrive. The invention may include a vision system and a less than lethal pepper spray system. A two-way audio system may be used to warn the burglar prior to activation of the LTLD. The vision system may enable the alarm monitoring station, the premises owner, or the police to verify that a burglary is taking place prior to activating the less than lethal system. The motion detector, vision system and LTLD may be housed in the same enclosure, which provides a 360 degree range in the field of view. The vision system may be used to automatically aim the LTLD. The vision system may include video motion detection technology that tracks a moving burglar and actuates a pan, tilt, zoom camera to keep the burglar in the field of view. The video tracking information may be used to aim the LTLD. The video image may be transmitted to a remote monitoring station. The person at the monitoring station may make the final decision to activate the LTLD. The monitoring station may have two-way audio communication with the person who triggered the alarm, which further reduces the chance of false triggering. The audio verification may convince the intruder to leave the premises prior to activation of the LTLD. In alternative embodiment, the audio/video information is sent to the premises owner's cell phone, and the owner enters a numeric code on the phone to activate the LTLD. When the alarm system is first triggered, a prerecorded voice warns the intruder that a LTLD will be activated unless he leaves the premises.

The invention comprises, in one form thereof, a security system including a video system for capturing images of an intruder. A deterrent dispensing device dispenses a deterrent substance in a selected direction. An actuator module is communicatively coupled to the video system and is coupled to the deterrent dispensing device. The actuator module receives a video signal from the video system and, in response thereto, controls the deterrent dispensing device to thereby aim the dispensed deterrent substance in a direction of the intruder.

The invention comprises, in another form thereof, a method of operating a security system, including using a video camera in the security system to capture images of a monitored area. A deterrent device is provided in the security system. It is decided whether to activate the deterrent device based upon the captured images.

The invention comprises, in yet another form thereof, a method of operating a security system, including using a video camera in the security system to capture images of a monitored area. A deterrent device is provided in the security system. A radio frequency video signal based upon the captured images is transmitted to a remote location. A radio frequency deterrent activation signal is received from the remote location. The deterrent activation signal indicates whether to activate the deterrent device. The deterrent activation signal is dependent on the captured images.

An advantage of the present invention is that individual building systems that are included in the security system may be quickly and easily removed and replaced with a fully functioning or upgraded building system without removing the security system from its use in the field.

Another advantage is that it is possible to remove and install individual building systems of the security system without the use of tools.

Yet another advantage is that it is not necessary to remove electrical power from the security system when removing or installing a building system.

A further advantage is that a number of diverse building systems may be installed in a compact and aesthetically pleasing package.

Still another advantage is that the security system enables the presence of an intruder to be visually verified before a LTLD is activated.

A still further advantage is that the LTLD may be aimed based on the location of an intruder as determined by a video system.

Another advantage is that a user at a remote location may view images captured by the video security system on a personal electronic device, and may then decide whether to activate the LTLD based on the viewed images.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
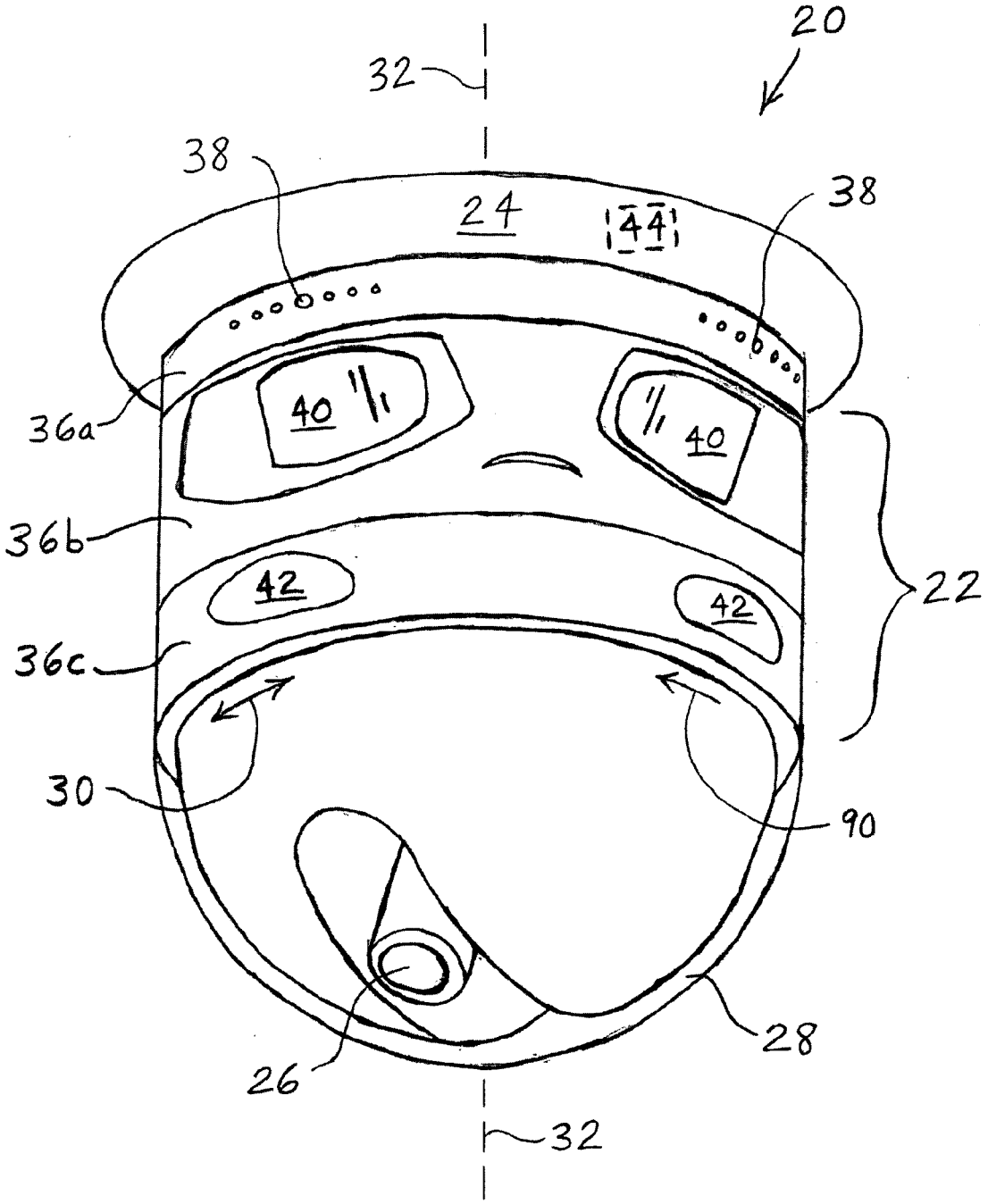
FIG. 1 is a bottom perspective view of one embodiment of a modular building system arrangement of the present invention.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DESCRIPTION OF THE PRESENT INVENTION

Figure 2:
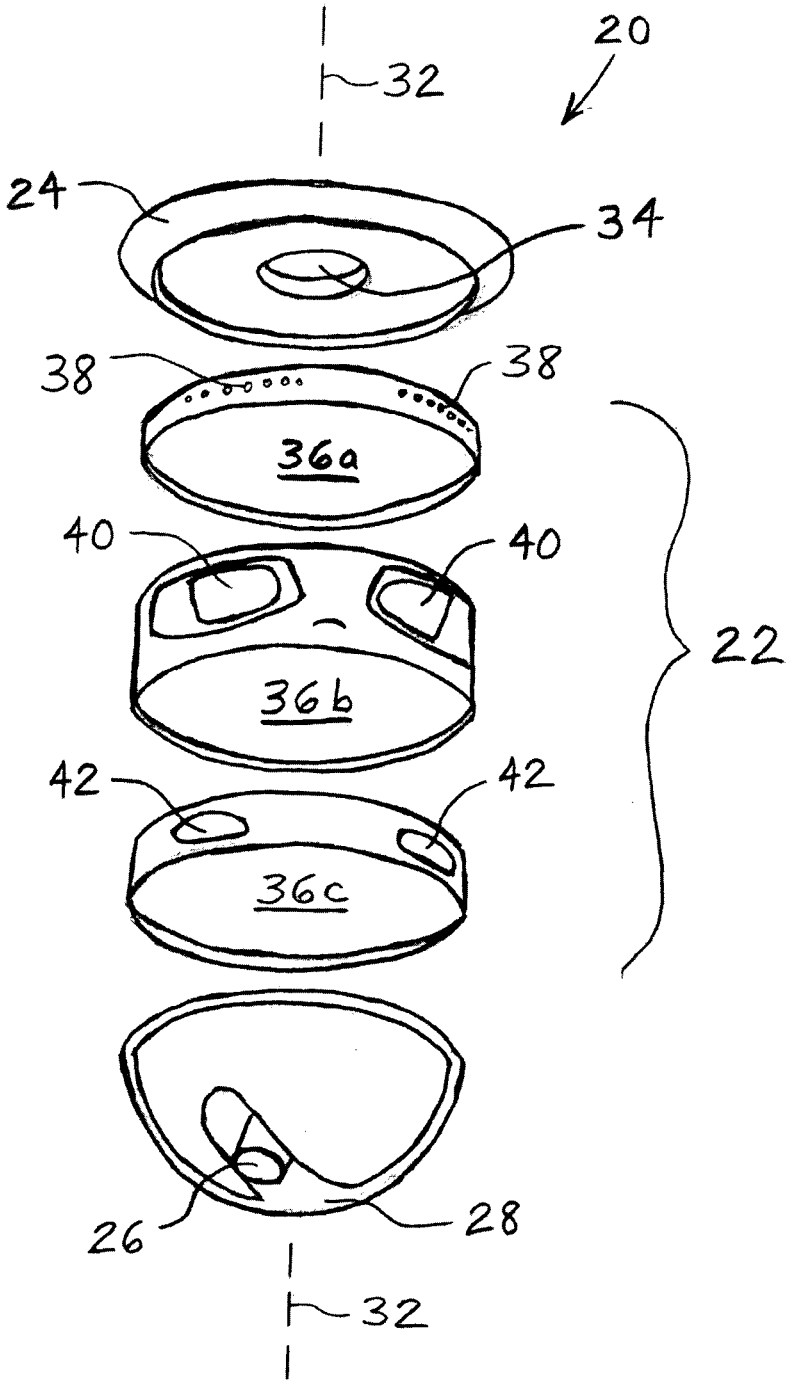
FIG. 2 is an exploded bottom perspective view of the modular building system arrangement of FIG. 1.
Figure 3:
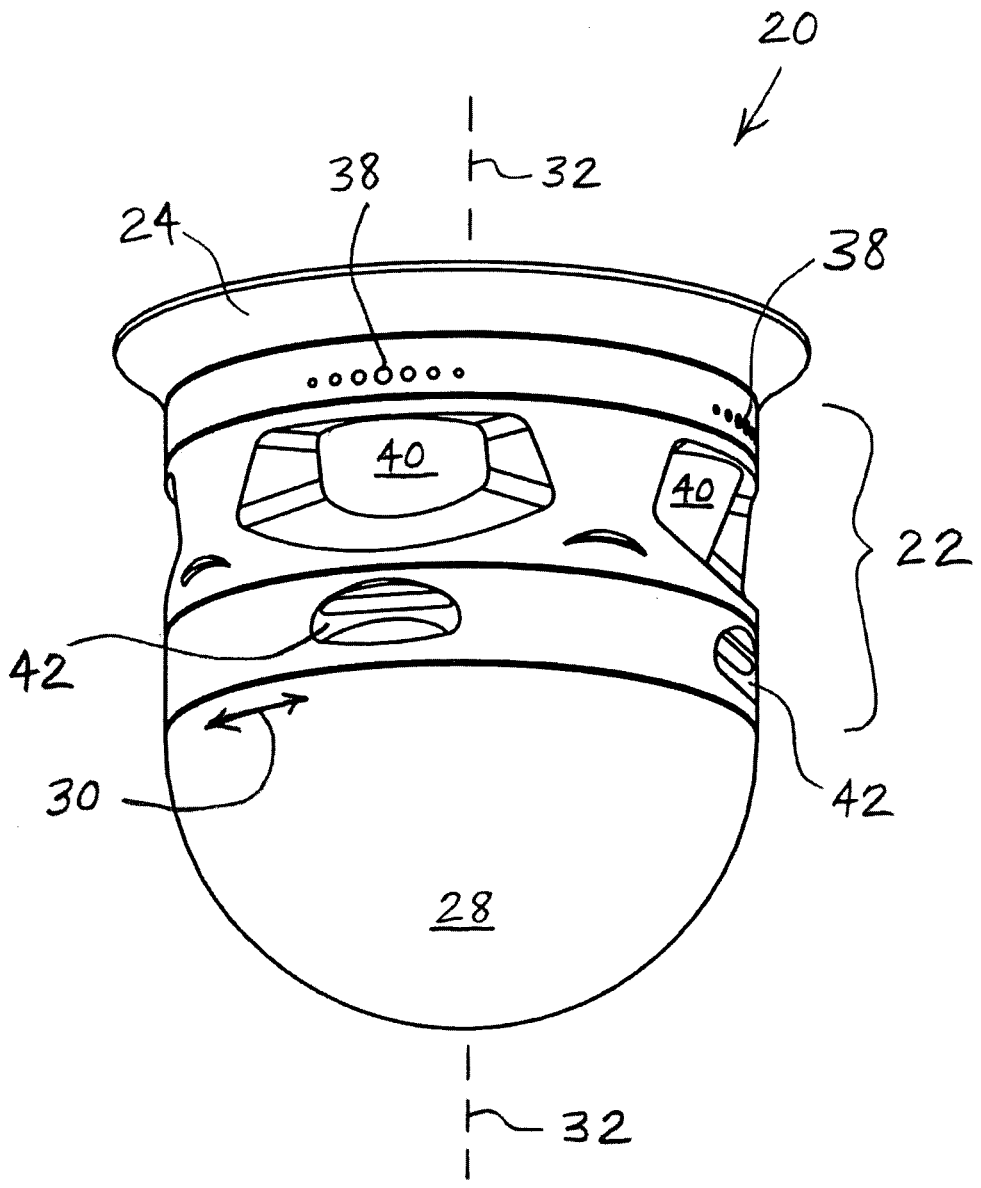
FIG. 3 is another bottom perspective view of the modular building system arrangement of FIG. 1.

Referring now to the drawings and particularly to FIGS. 1 and 2, there is shown one embodiment of a modular building system arrangement 20 of the present invention for incorporation into a fixed structure such as a building, or, more particularly, a ceiling of a building. Modular building system arrangement 20 includes a building system assembly 22 coupled to a base 24 at an upper end thereof, and to an electrical end cap module in the form of a surveillance camera 26 at a lower end thereof. Camera 26 may be connected to a hemispherical covert liner 28 that covers camera 26. Although camera 26 is visible through liner 28 in FIG. 1 for ease of illustration, liner 28 may be opaque when viewing in a radially inward direction such that camera 26 cannot be seen with the naked eye by a casual observer, as shown in FIG. 3. However, camera 26 may capture, through liner 28, images of objects outside of liner 28. Camera head 26 may be rotatable relative to the remainder of arrangement 20 in directions indicated by double arrow 30 about a pan axis or longitudinal axis 32.

Base 24 may be secured to a ceiling or other fixed structure such as by screws. Base 24 may include a through channel 34 for carrying wires (not shown) therein. The wires may extend through the ceiling or other fixed structure. The wires may provide electrical power and control signals or other data from a camera monitoring system, "head end unit", or other controller to building system assembly 22 and surveillance camera 26. The wires may also carry data and signals, including video signals from camera 26 and signals from building system assembly 22 to the camera monitoring system or other controller.

Building system assembly 22 may include different building systems 36*a-c* stacked on top of each other such that building systems 36*a-c* are aligned along axis 32. In the particular embodiment shown in the drawings, assembly 22 includes building systems in the form of a microphone ring 36*a*, a passive infrared (PIR) motion detection ring 36*b*, and a lighting ring 36*c*. Microphone ring 36*a* includes multiple microphones 38 for location identification. That is, monitoring personnel may determine the location of intruders and other sources of sound by listening to the outputs of microphones 38. For example, microphone ring 36*a* may support a glass break alarm function which uses direction information for the glass break function. The direction information may also be used to decide in which direction to steer or point camera 26. Microphone ring 36*a* generally provides listen-in audio to a central station or end user.

PIR motion detection ring 36*b* may include four PIR sensors 40 to provide motion quadrant information that may be used to point camera 26. PIR motion detection ring 36*b* may also provide a motion alarm signal, which may be fused with video motion detection.

Lighting ring 36*c* includes light bulbs 42 for providing room lighting, or for illuminating the images captured by camera 26. Lighting ring 36*c* may be in the form of a strobe ring that provides a strobe light or flash for a fire alarm, a quick flash sequence for camera illumination, and/or a high output flash for confusing an intruder.

Base 24 may include a processor 44 which collects data from building systems 36 and camera 26 and which performs some processing and/or control operations. For example, processor 44 may receive PIR quadrant information transmitted by PIR sensors 40 and may use this information to reposition camera 26. Processor 44 may also receive video motion detection information from camera 26 and may use this information to verify an alarm signal from PIR sensors 40. Processor 44 may function as a centralized controller for all of building system arrangement 20. Processor 44 may communicate audio, video, motion alarms, etc., via internet protocol (IP).

Base 24 may also include a slip ring (not shown) which enables camera head 26 to rotate freely while still maintaining electrical contact between camera 26 and the wires carried in through channel 34. More particularly, the slip ring may have a bottom terminal that is rotatable along with camera head 26. Base 24 may include a local bus structure which enables communication between processor 44, building systems 36, and camera 26 via the slip ring. Instead of a slip ring, in another embodiment base 24 may be powered by AC mains and may communicate via radio frequency (e.g., Zigbee) in order to simplify wiring and installation. Base 24 may include firmware that may be updated via internet protocol. Base 24 may incorporate some level of sensor data fusion or function as a sensor data information hub.

Camera 26 may be positioned in the bottommost position of arrangement 20, as shown in the drawings, such that camera 26 is provided with an optimal view that is unimpeded by building systems 36. In embodiments wherein video is not needed, camera 26 may be omitted and liner 28 may nevertheless be provided as a "dummy dome" in order to cause would be wrongdoers to believe that their actions may be monitored and/or recorded on video. Instead of a dummy dome, a low profile end cap could be provided at the bottommost position in applications wherein video is not needed.

Figure 4:
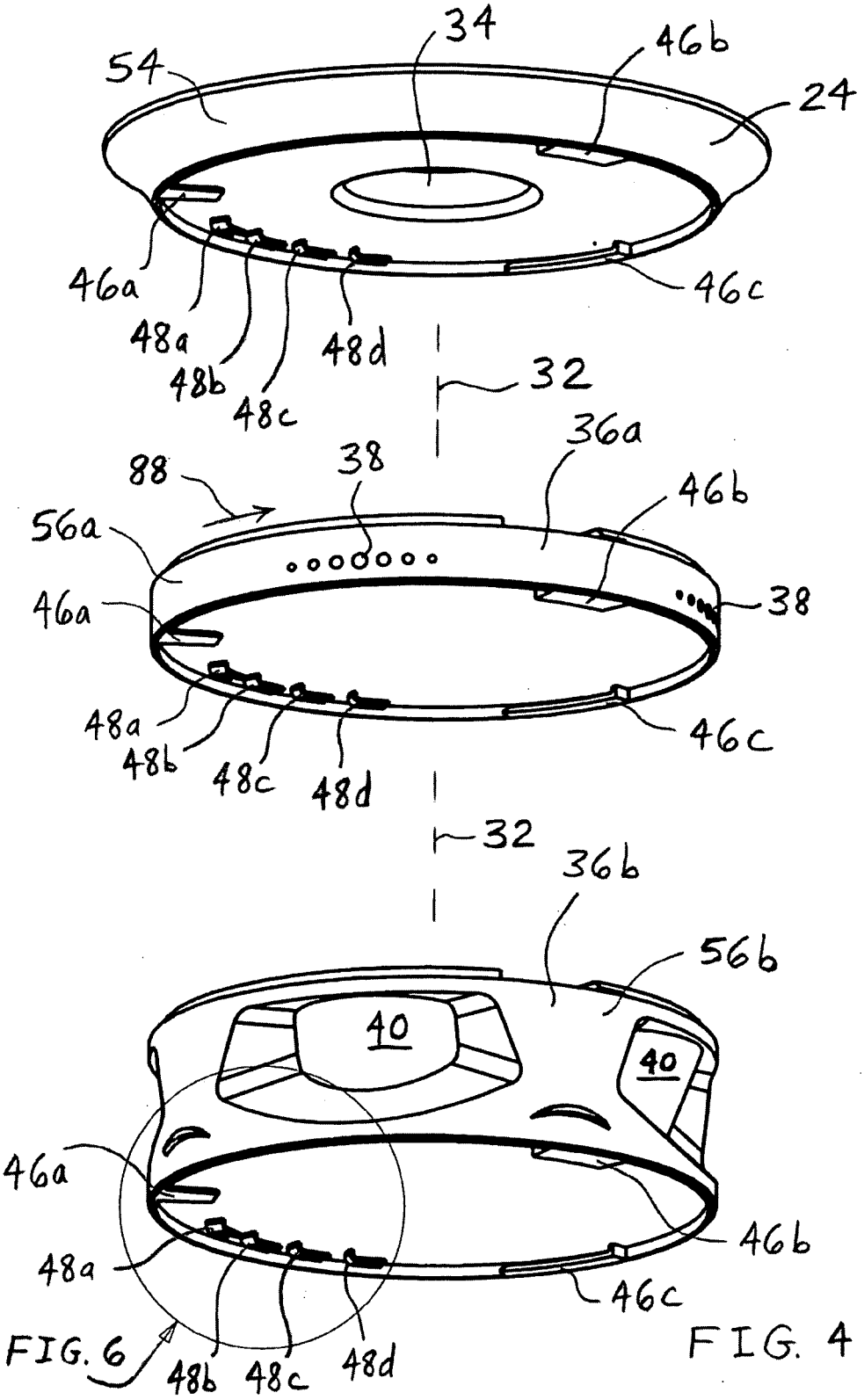
FIG. 4 is an enlarged exploded bottom perspective view of the base and top two building systems of the modular building system arrangement of FIG. 1.
Figure 5:
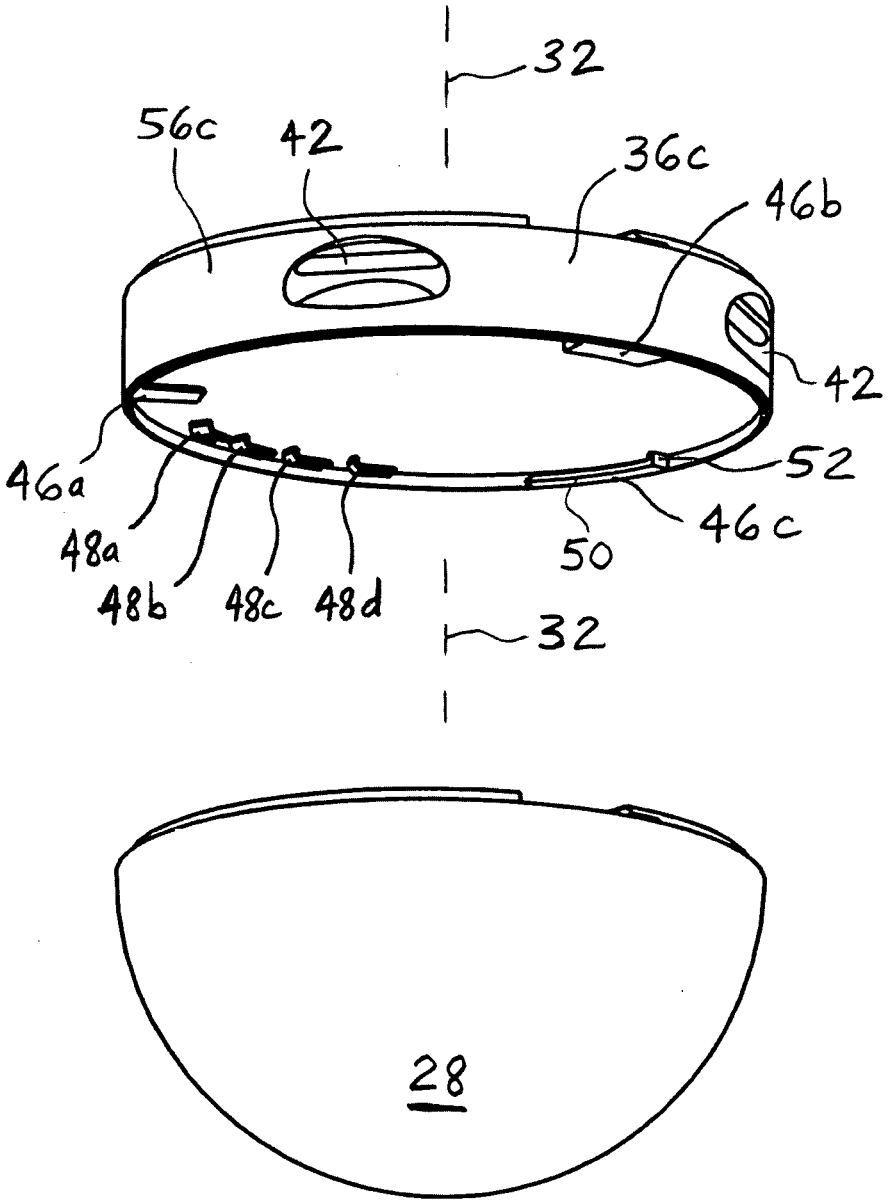
FIG. 5 is an enlarged exploded bottom perspective view of the bottom building system and end cap of the modular building system arrangement of FIG. 1.

As shown in the more detailed views of FIGS. 4 and 5, each of base 24, building system 36*a*, building system 36*b*, and building system 36*c* includes an identical set of mechanical connectors 46*a-c* and an identical set of female electrical connectors or metal clips 48*a-d*. In addition to each set of mechanical connectors and each set of electrical connectors being identical, each of mechanical connectors 46*a-c* within a set may be identical, and each of electrical connectors 48*a-d* within a set may be identical. Each of mechanical connectors 46*a-c* may be L-shaped and may include a cantilever arcuate portion 50 (FIG. 5) connected to a cantilever arm portion 52 extending upwardly from an end of portion 50. Each of arcuate portion 50 and arm portion 52 projects in a radially inward direction from a corresponding annular housing 54, 56*a-c* of base 24 and building systems 36*a-c*, respectively.

Figure 6:
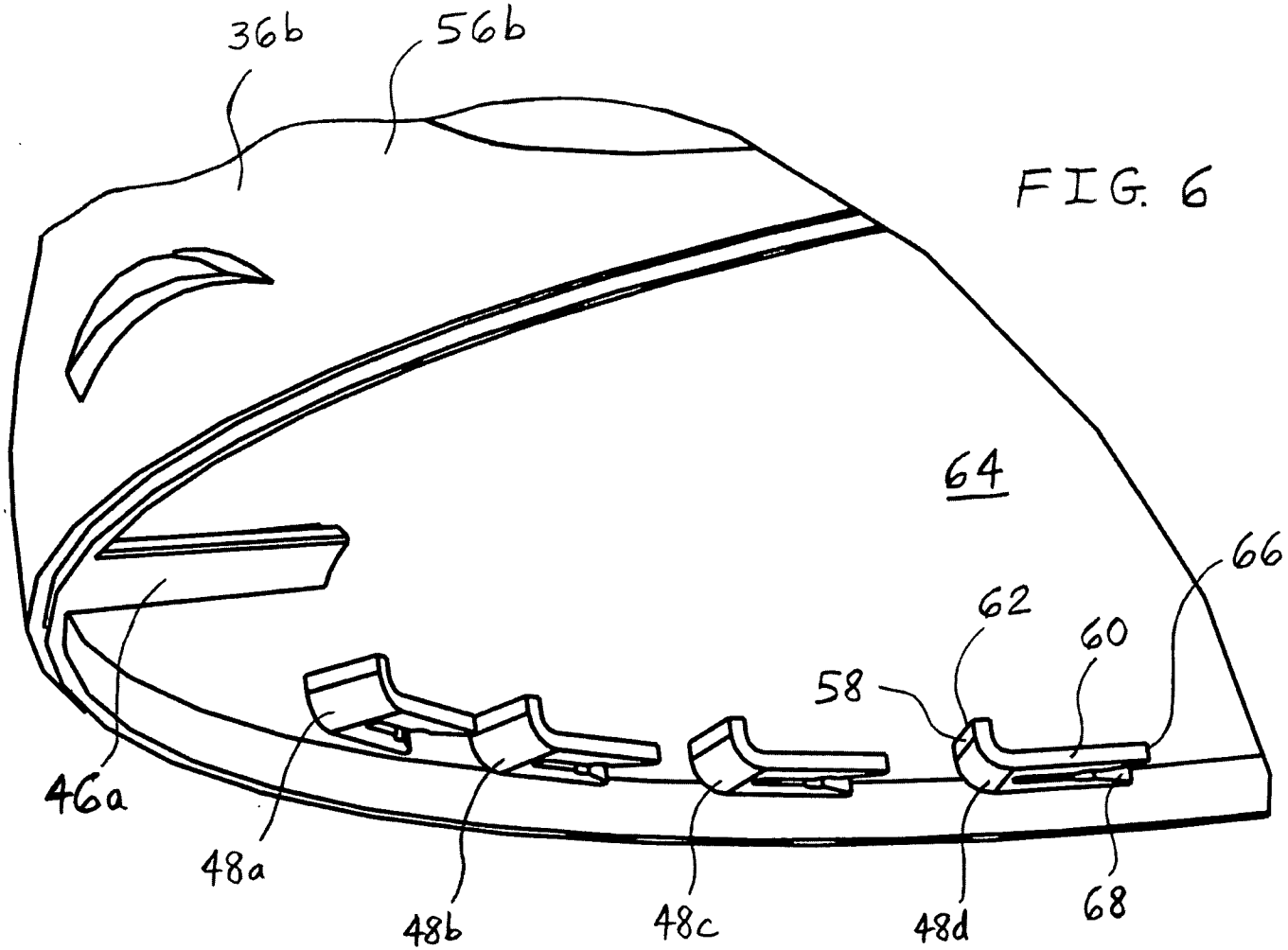
FIG. 6 is a fragmentary enlarged bottom perspective view of the bottom building system of FIG. 5.
Figure 7:
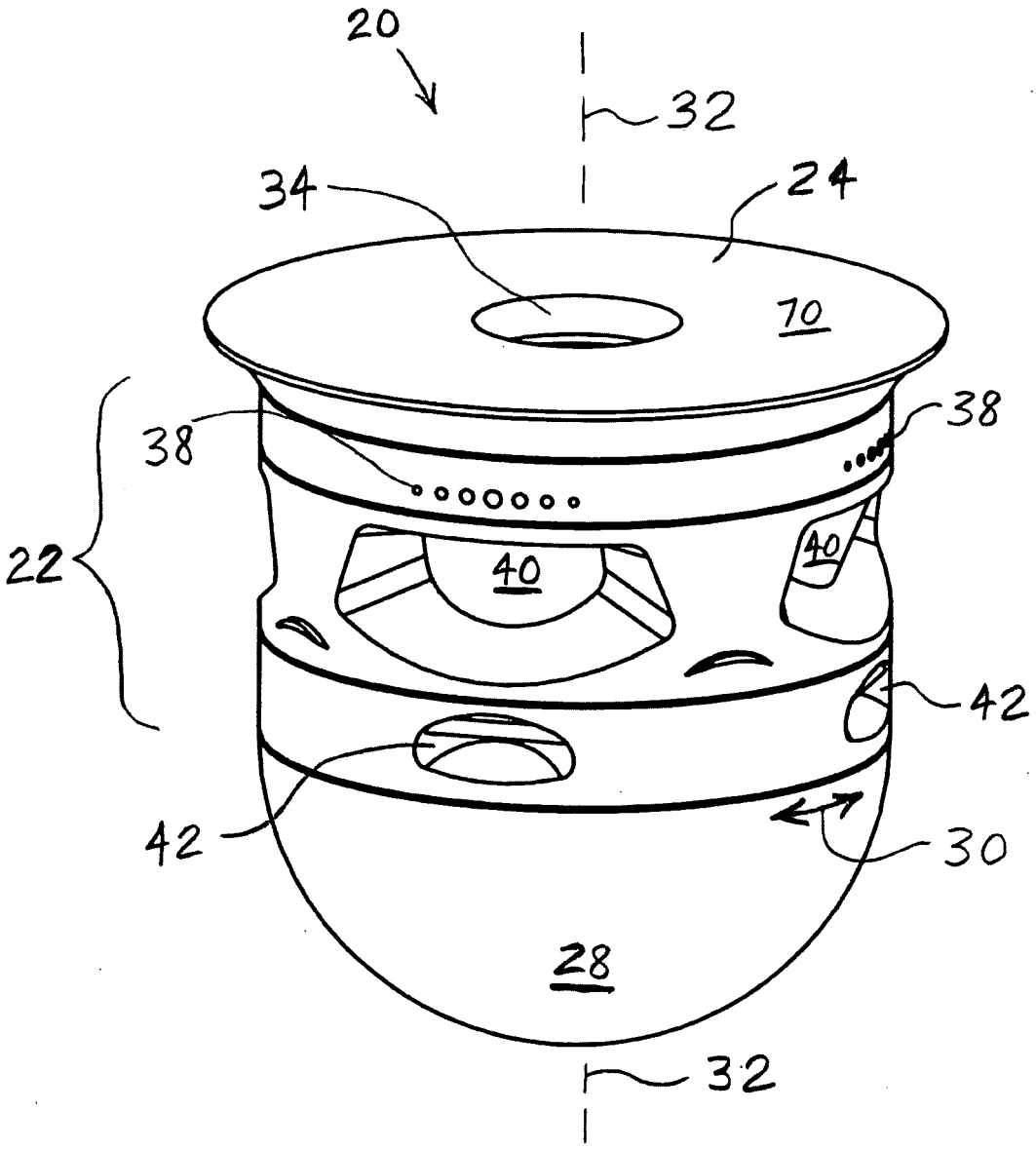
FIG. 7 is a top perspective view of the modular building system arrangement of FIG.

As shown in the enlarged view of FIG. 6, each of electrical connectors 48*a-d* is substantially L-shaped, having a shorter leg 58 and a longer leg 60. An upper end 62 of shorter leg 58 is attached to a bottom surface 64 of building system 56*b*. A distal end 66 of longer leg 60 includes a substantially V-shaped notch 68. Each of notches 68 opens in a circumferential direction.

FIGS. 7-10 illustrate arrangement 20 from an upper perspective view. An upper surface 70 of base 24 may engage, and be mounted to, a ceiling or other fixed structure.

Figure 8:
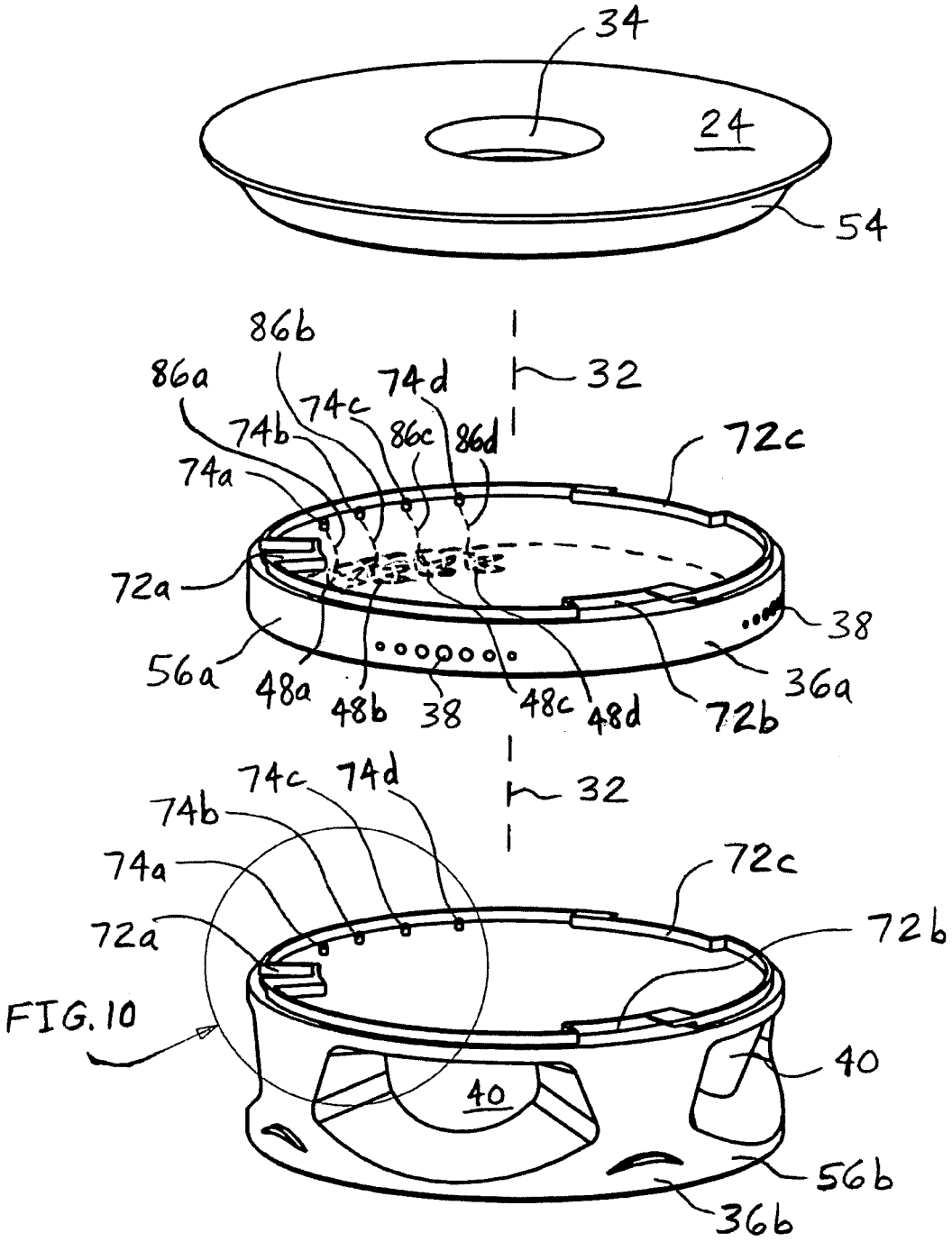
FIG. 8 is an enlarged exploded top perspective view of the base and top two building systems of the modular building system arrangement of FIG. 1.
Figure 9:
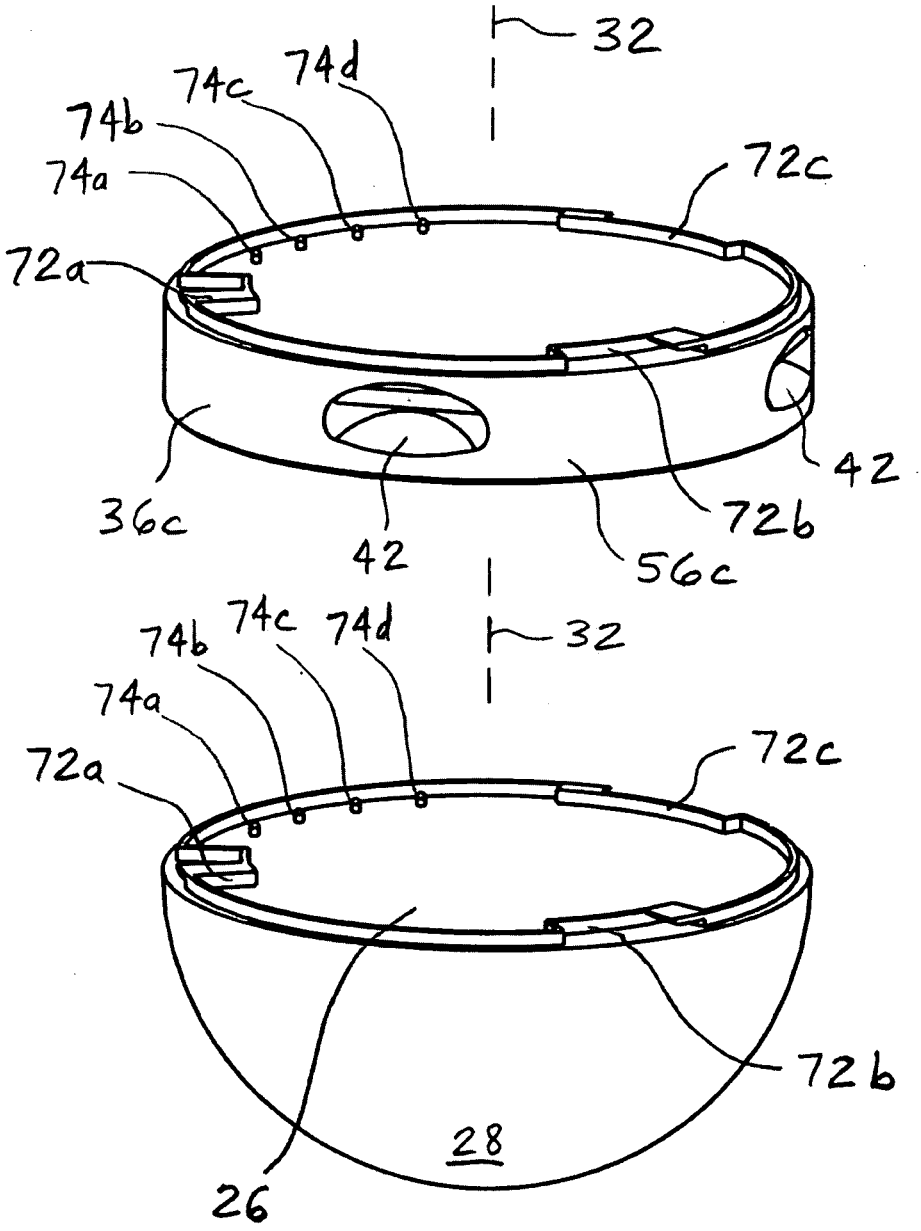
FIG. 9 is an enlarged exploded top perspective view of the bottom building system and end cap of the modular building system arrangement of FIG. 1.

As shown in the exploded views of FIGS. 8 and 9, each of building systems 36*a-c* and camera 26 includes an identical set of mechanical connectors 72*a-c* and an identical set of male electrical connectors 74*a-d*. In addition to each set of mechanical connectors and each set of electrical connectors being identical, each of mechanical connectors 72*a-c* within a set may be identical, and each of electrical connectors 74*a-d* within a set may be identical. Each of mechanical connectors 72*a-c* may be in the form of a slot 75 (FIG. 10) defined by opposite end walls 76, 78, an inner arcuate wall 80, and a top wall 82 connected to both end wall 78 and an end of arcuate wall 80 that is adjacent to end wall 78.

Figure 10:
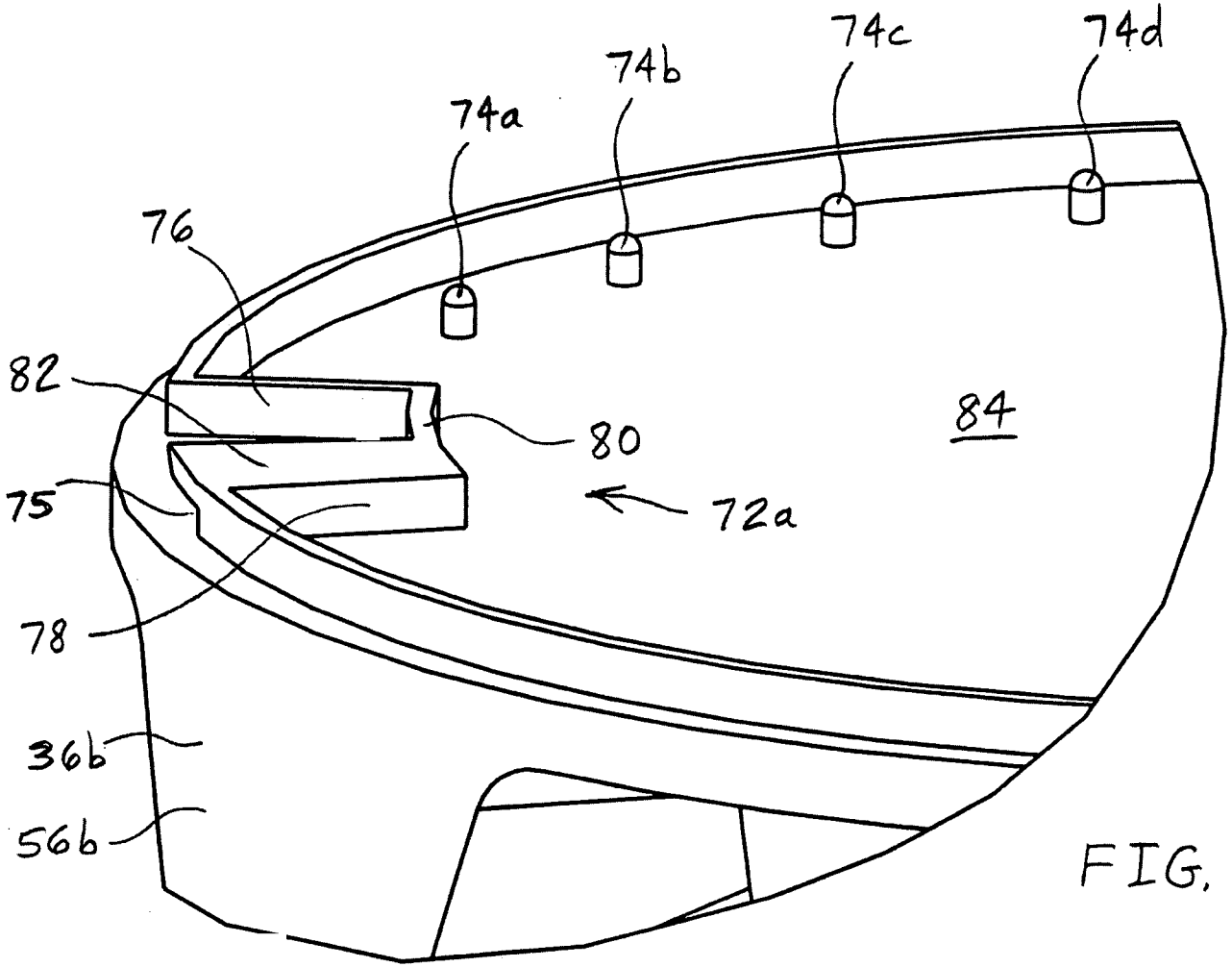
FIG. 10 is a fragmentary enlarged top perspective view of the bottom building system of FIG. 9.

As shown in the enlarged view of FIG. 10, each of electrical connectors 74*a-d* is in the form of a peg-shaped projection extending from upper surface 84 of building system 36*b*. Connectors 74*a-d* may each extend in a direction parallel to axis 32.

Each of electrical connectors 74*a-d* is electrically connected to a respective one of electrical connectors 48*a-d* within the same building system via a respective one of electrical conductors 86*a-d*, as shown in FIG. 8. When arrangement 20 is fully assembled, as in FIGS. 1, 3 and 7, conductors 86*a-d* in building systems 36*a-c* provide continuous electrical pathways between connectors 46*a-d* in base 24 and respective connectors 74*a-d* in camera 26. In one embodiment, two of these four electrically conductive pathways carry power (i.e., positive and negative voltage or positive voltage and ground) to one or more of base 24, building systems 36*a-c* and camera 26. The other two of the four electrically conductive pathways may carry control signals and/or data, such as video data and control signals for camera 26.

During assembly or installation, base 24 may first be secured to the ceiling by screws or other fasteners. Building system 36*a* may then be secured to base 24 by first aligning the open portions of mechanical connectors 72*a-c* (i.e., the portions of slots 75 not covered by top wall 82) of building system 36*a* with mechanical connectors 46*a-c* of base 24. After this alignment, building system 36*a* may be moved toward base 24 in an axial direction along pan axis 32 until connectors 46*a-c* are received in the open portions of slots 75. In this position, electrically connecting pegs 74*a-d* are disposed adjacent to distal ends of metal clips 48*a-d*, respectively, of base 24. Next, building system 36*a* may be rotated approximately one-eighth turn (i.e., 45 degrees) about axis 32 in the direction indicated by arrow 88 (FIG. 4) until each of mechanical connectors 46*a-c* is at least partially received in a portion of slot 75 that is covered by top wall 82 of a respective one of mechanical connectors 72*a-c*. Each of electrical connectors 74*a-d* is also received in a notch 68 of a respective one of electrical connectors 48*a-d* as building system 36*a* is rotated. Building system 36*a* may then be released to enable top walls 82 of connectors 72*a-c* to rest upon and be supported by respective mechanical connectors 46*a-c*.

Building system 36*b* may be connected to building system 36*a* in substantially the same manner as described above for connecting building system 36*a* to base 24. In turn, building system 36*c* may be connected to building system 36*b*, and camera 26 may be connected to building system 36*c* in substantially the same manner.

As may be evident from the above description of the modularity of the electrical and mechanical connectors of base 24, building systems 36*a-c*, camera 26 and their housings, it is possible to arrange building systems 36*a-c* in any order between base 24 and camera 26. That is, building system 36*b* may be connected directly to base 24 with either system 36*a* in the middle and system 36*c* connected to camera 26, or with system 36*c* in the middle and system 36*a* connected to camera 26. Similarly, building system 36*c* may be connected directly to base 24 with either system 36*a* in the middle and system 36*b* connected to camera 26, or with system 36*b* in the middle and system 36*a* connected to camera 26.

The above-described modularity of arrangement 20 further enables any number of building systems 36 to be included in a building system assembly. That is, although three building systems 36*a-c* are shown in the embodiment of the drawings, any other number of building systems (e.g., one, two, four, five, etc.) may be included in a modular building system arrangement of the invention.

Additional types of building systems that may be employed in the present invention include an audio output building system (not shown) which provides a synchronized siren function for intrusion alarm and fire/smoke alarm. The audio output building system may also provide public address (PA) voice function; two-way communications when used with microphone ring 36*a*; and/or a background music function.

Another building system that may be employed is a less-than-lethal-deterrent type, which is intended to deter or inhibit the intended actions of a sensed intruder. Such less-than-lethal-deterrent building systems may be characterized by a pepper spray cloud that fills a large area; a pepper spray stream that is aimed by use of target location information provided by camera video motion sensing; high output sound pressure; a tazer gun (i.e., stun gun) that is aimed by use of target location information provided by camera video motion sensing; a smoke screen, such a theatrical smoke, that is used to confuse an intruder and prevent the intruder from seeing things that can be stolen; or a stink bomb, which is less intrusive than other options above. In one embodiment, the above-described less-than-lethal-deterrent building systems are aimed or armed by a human in a central station. Such less-than-lethal-deterrent building systems may have the advantage of providing a faster response to an intruder than may be provided by local police.

Other types of building systems that may be included in the present invention include a smoke alarm building system, and a temperature sensor building system. The smoke alarm building system, after sensing smoke, may transmit an alarm signal only if the presence of smoke and/or fire is verified by video data provided by camera 26. The temperature sensor building system may provide a low temperature alarm signal and/or a high temperature alarm signal.

All of the additional types of building systems described above may have the same types of electrical and mechanical connectors as building systems 36*a-c*. Thus, a building system assembly may be formed of any combination or number of the building systems described herein, and the building systems may be assembled in any order from the base to the camera or other type of end cap.

In a particular embodiment, base 24, camera 26, and each of the above-described building systems (i.e., building systems 36*a-c* and the additional building systems described by not shown herein) may be provided in a kit. The end user or installer may then choose a subset of the building systems provided in the kit to include in a building system assembly that suits the requirements of a particular application.

During removal, or uninstallation, the human user may grasp camera 26 and rotate it in direction 90 (FIG. 1) that is opposite to direction 88. As camera 26 rotates in direction 90, mechanical connectors 46*a-c* slide completely out of the covered portions of slots 75 and become aligned with the open portions of slots 75. In this position, camera 26 may be pulled away from building system 36*c* in a direction parallel to axis 32. Similarly, by rotating building system 36*c* in direction 90, building system 36*c* may be decoupled from building system 36*b* such that system 36*c* may be pulled away from system 36*b* in the direction parallel to axis 32. This procedure may be repeated until each of the building systems, or the building system that is desired to be removed, has been pulled away from the remainder of arrangement 20. For example, camera 26 may be thus removed from building system assembly 22, and a different camera 26 may be installed on building system assembly 22 if so desired.

As described above, base 24 may be mounted to a ceiling of a room. However, base 24 may alternatively be mounted to a vertical surface such as a wall. A pendant-type housing that is attached to a wall, and the coupling between a housing and a surveillance window, are disclosed in U.S. patent application Ser. No. 10/967,856, entitled COMPOUND DOME WINDOW FOR A SURVEILLANCE CAMERA, filed Oct. 18, 2004, now U.S. Pat. No. 7,306,383, which is hereby incorporated by reference herein.

According to the present invention, a modular building system kit may further include one or more additional versions of the base, building systems and the camera. Thus, the kit may include a group of bases, a group of microphone building systems, a group of PIR motion detection building systems, a group of lighting building systems, groups of the other building systems described herein, and a group of cameras. A user or assembler may select one representative unit from each of the groups, or from a subset of the groups, to thereby assemble a building system arrangement in a selected one of a plurality of possible combinations. Each of the units within a given group may have a respective set of performance characteristics, and the selectable units across all of the groups may have common electrical and mechanical connectors. Thus, each building system may be interchangeable with a building system of the same group or of any other group of building systems in terms of mechanical and electrical connectivity, and perhaps also in terms of size and shape. For example, each of the building systems and the camera may have an outer housing with a circular shape when viewed along axis 32. Further, the outer housings of each of the building systems and the camera may have an equal diameter and circumference. This constant size and shape provides arrangement 20 with a profile that has a constant width along axis 32 and that is constant from any viewpoint along the 360 degree arc surrounding axis 32. However, it is possible within the scope of the invention that, due to the different performance characteristics of the units within a group, not all units within a given group are fully operationally compatible with all units of the other groups.

When one of the units needs to be upgraded or replaced due to a malfunction, the unit may be relatively easily replaced with a unit from the same group or from a different group without the need for special tools. Thus, the building system arrangement may be upgraded or serviced in the field without having to send the entire building system arrangement to a repair facility. Additionally, the building system kit of the present invention advantageously allows a manufacturer to more easily manufacture replacement parts and new, more advanced parts due to the modular configuration. Thus, a user of the building system arrangement can easily upgrade or reconfigure the system to the user's dynamic specifications.

In one embodiment, arrangement 20 includes electrical circuitry, e.g., hot swap circuitry (not shown) and/or tristatable signal lines, at the interfaces with between base 24, building systems 36*a-c* and camera 26. Hot swap circuitry may include components to prevent an in-rush of current when a new unit is installed with power supplied to the building system arrangement. Alternatively, the electrical connections may comprise any other in-rush current limiting electrical connections. Such hot swap circuitry may include resistor-capacitor circuits or other dampening circuits for reducing the magnitude and/or time duration of voltage transients or current transients to which a unit may be exposed upon being connected to an energized unit. Hot swap circuitry essentially reduces the chance of damage from unintended current paths to components or units that are added to the building system arrangement while the power remains supplied thereto. For example, the hot swap circuitry may enable camera 26 to be moved into electrical connection with an energized building system 36 and/or with an energized base 24 with a reduced risk of damage therefrom. The hot swap circuitry may additionally or alternatively enable a building system 36 to be moved into electrical connection with any other energized building system or with an energized base 24 with a reduced risk of damage therefrom. Hot swap circuitry is described in an article entitled "Introduction to Hot Swap", authored by Jonathan M. Bearfield of Texas Instruments, available at www.techonline.com, published on Sep. 24, 2001, the disclosure of which is hereby expressly incorporated herein by reference.

Tristatable signal lines may provide high, low, and disabled electrical states. The disabled state, in which the signal lines are provided with a high level of electrical resistance, may take effect whenever a video signal from the camera is lost or is turned off. Thus, in the disabled state, a camera may be serviced or replaced with a reduced risk of high currents entering and possibly damaging the camera.

Particular mechanical and electrical couplings between camera 26, building systems 36*a-c* and base 24 are described above with reference to FIGS. 1-10. However, it is to be understood that camera 26, building systems 36*a-c* and base 24 may be coupled to each other via other suitable electrical and mechanical connections. For example, a camera may be mechanically attached to a building system or to a base via a bayonet-type connection, a snap-fit engagement, a threaded engagement, one or more fasteners, or any other type of suitable connection which permits easy removal while simultaneously providing secure mechanical connection and simultaneous electrical connection.

During service or assembly, a user or repair person of building system arrangement 20 may advantageously remove and replace each of the units of building system arrangement 20 with an upgraded version or with a repaired version of each unit, or reconfigure a system of multiple arrangements by interchanging units between multiple arrangements in the system. For example, when a retailer rearranges displays to produce different traffic patterns through the store, he may swap system controllers between two cameras to place autotracking capability in a different location. Similarly, it may be desirable to swap a pan, tilt, zoom (PTZ) camera with a fixed or imitation camera. Building system arrangement 20 has modular capability, i.e., each component may be replaced or repaired without removing or reinstalling the entire building system arrangement 20. For example, building system 36*b* may be removed and replaced with an upgraded unit or with a repaired unit, if building system 36*b* has malfunctioned, without changing the components or the configuration of the remainder of building system arrangement 20. As described above, the user may selectively remove building system 36*b* from its mechanical and electrical connections to building system 36*a* and to building system 36*c*. Similarly, base 24, building system 36*a*, building system 36*c*, and camera 26 may be selectively removed and replaced with an upgraded but like unit or with a repaired like unit without changing the components or the configuration of the remainder of building system arrangement 20.

Due to the modularity of the building system arrangement, the present invention may be provided in the form of a kit including groups of different versions of the various units. The versions of the units may differ in terms of their respective sets of performance characteristics, but may have the same shape, size, and mechanical and electrical connectors. The installer may assemble a building system arrangement in a selected one of a plurality of possible combinations by selecting one version from each unit group.

Due to the common size and shape of the units within a certain group, any combination of the base, building systems and camera may have a same, constant width as measured in a horizontal direction. Further, any camera may be coupled to any bottommost building system such that the camera has an unimpeded view.

In an embodiment of a method of the present invention, an operator of a site, such as a casino or retail store, may select a camera from a group of cameras each having a respective set of performance characteristics and common electrical and mechanical connectors. One or more building systems may also be selected from a group of building systems each having a respective set of performance characteristics and common electrical and mechanical connectors. Each of the building systems may be operationally compatible with two or more of the cameras. A base may further be selected from a group of bases each having a respective set of performance characteristics and common electrical and mechanical connectors. Each of the bases may be operationally compatible with two or more of the cameras and with two or more of the building systems. A building system arrangement may be assembled such that the selected camera is coupled to an assembly of building systems and such that the selected assembly of building systems electrically and mechanically interconnects the selected camera and the selected base.

As may be characteristic of modularity, each of the various units of a group of like units may have a substantially similar appearance. Thus, the appearance of one unit of a group may be representative of the appearance of every other unit of the group of like units.

Although only a single modular building system arrangement 20 has been described herein, in another embodiment, multiple modular building system arrangements are networked together. The networked arrangements may be in a single building or may be in multiple buildings. Each arrangement may share the sensor data it produces with every other arrangement in the network. Thus, an arrangement may react, such as by activating an alarm siren, to sensor data received from any other arrangement in the network.

Figure 11:
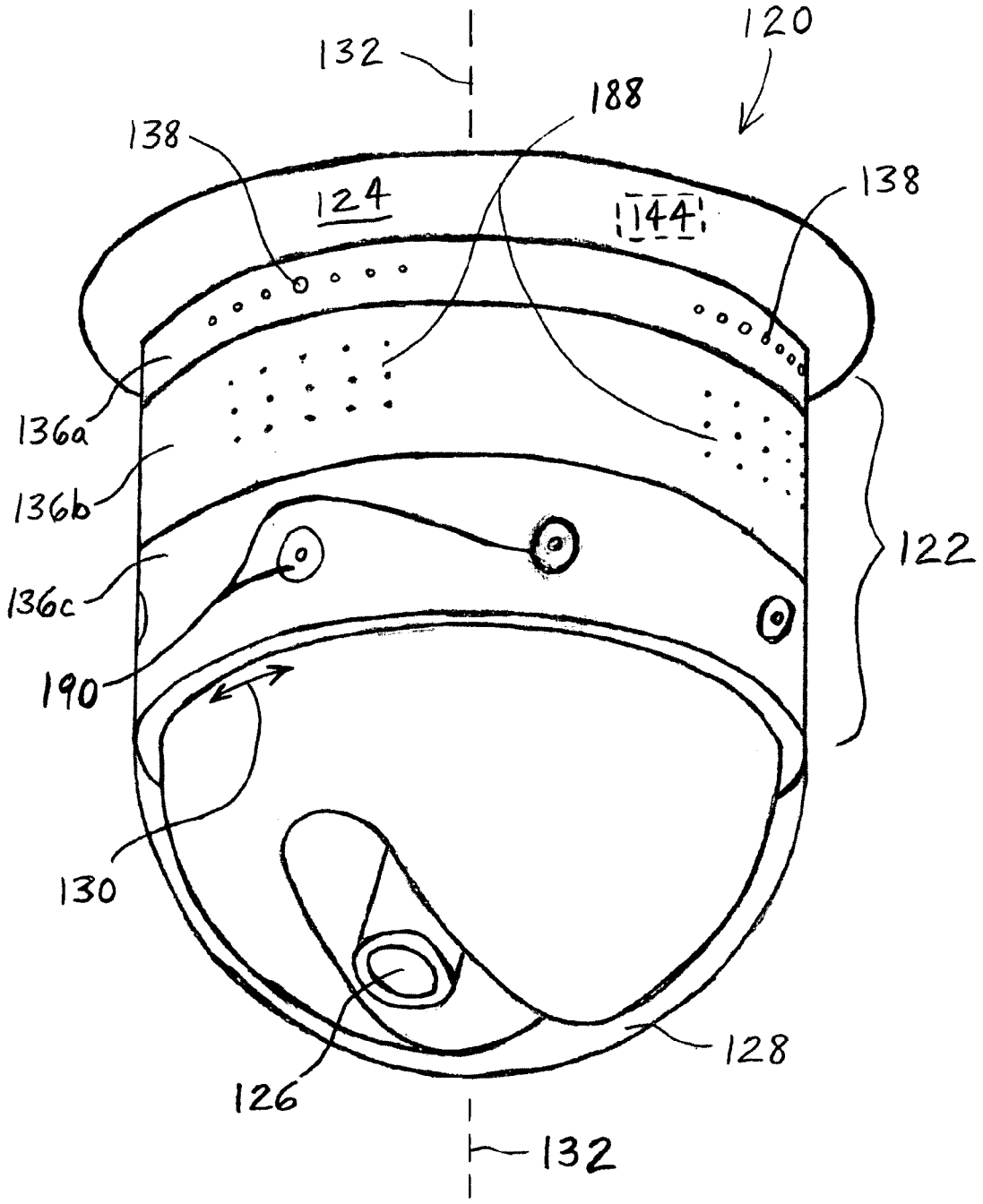
FIG. 11 is a bottom perspective view of another embodiment of a modular building system arrangement of the present invention.

An embodiment of a modular security system 120 of the present invention for incorporation into a fixed structure such as a building, or, more particularly, a ceiling of a building, is shown in FIG. 11. Modular security system 120 includes a security system assembly 122 coupled to a base 124 at an upper end thereof, and to a surveillance camera 126 at a lower end thereof. Camera 126 may be connected to a hemispherical covert liner 128 that covers camera 126. Although camera 126 is visible through liner 128 in FIG. 11 for ease of illustration, liner 128 may be opaque when viewing in a radially inward direction such that camera 126 cannot be seen with the naked eye by a casual observer, similarly to as shown in FIG. 3. However, camera 126 may capture, through liner 128, images of objects outside of liner 128. Camera head 126 may be rotatable relative to the remainder of system 120 in directions indicated by double arrow 130 about a pan axis or longitudinal axis 132.

Base 124 may be secured to a ceiling or other fixed structure such as by screws. Base 124 may include a through channel (not shown) similar to through channel 34 in FIG. 2 for carrying wires (not shown) therein. The wires may extend through the ceiling or other fixed structure. The wires may provide electrical power and control signals or other data from a camera monitoring system, "head end unit", or other controller to security system assembly 122 and surveillance camera 126. The wires may also carry data and signals, including video signals from camera 126 and signals from security system assembly 122 to the camera monitoring system or other controller.

Security system assembly 122 may include different security systems 136*a-c* stacked on top of each other such that security systems 136*a-c* are aligned along axis 132. In the particular embodiment shown in the drawings, assembly 122 includes security systems in the form of a microphone ring 136*a*, an audio speaker ring 136*b*, and a less than lethal deterrent in the form of a pepper spray dispensing ring 136*c*. Microphone ring 136*a* includes multiple microphones 138 (in one embodiment, four microphones 138 spaced 90 degrees apart along the circumference) for location identification. That is, monitoring personnel may determine the location of intruders and other sources of sound by listening to the outputs of microphones 138. For example, microphone ring 136*a* may support a glass break alarm function which uses direction information for the glass break function. The direction information may also be used by processor 144 to decide in which direction to steer or point camera 126. The direction information from microphone ring 136*a* may also be used to decide in which direction to aim pepper spray from pepper spray ring 136*c*. These decisions on the directions to point camera 126 and/or the pepper spray from ring 136*c* may be performed automatically by processor 144 of base 124 or may be made by and/or overridden by a human at a remote location. Microphone ring 136*a* generally provides listen-in audio to a central station or end user.

Audio speaker ring 136*b* may include four speakers 188 to provide audible output within the monitored area. The source of the audio signals sent to speakers 188 may be processor 144 or may be a human. The human may be at a monitoring center or may be the user speaking into a personal electronic device. Regardless of the source of the audio signals sent to speakers 188, the content of the audio signals may be a spoken warning, which may be an actual human voice spoken in real time or a simulated voice, warning any person within hearing range of system 120, such as an intruder, that a LTLD will be activated within a short period of time. Speakers 188 themselves may also function as a LTLD. For example, speakers 188 may produce high output sound pressure for forcing an intruder out of the monitored premises.

Pepper spray ring 136*c* includes multiple nozzles 190 (in the embodiment shown in FIG. 11, eight nozzles 190) for emitting a LTLD substance, such as pepper spray, into the monitored area for driving out a sensed intruder. Inputs from camera 126, microphones 138 and possibly PIR sensors may be used to determine the location of an intruder relative to system 120. After the location of an intruder has been determined, a subset of nozzles 190, such as between one and four of the eight nozzles 190, that are generally pointed in the direction of the intruder may be activated to emit pepper spray therefrom.

Figure 12:
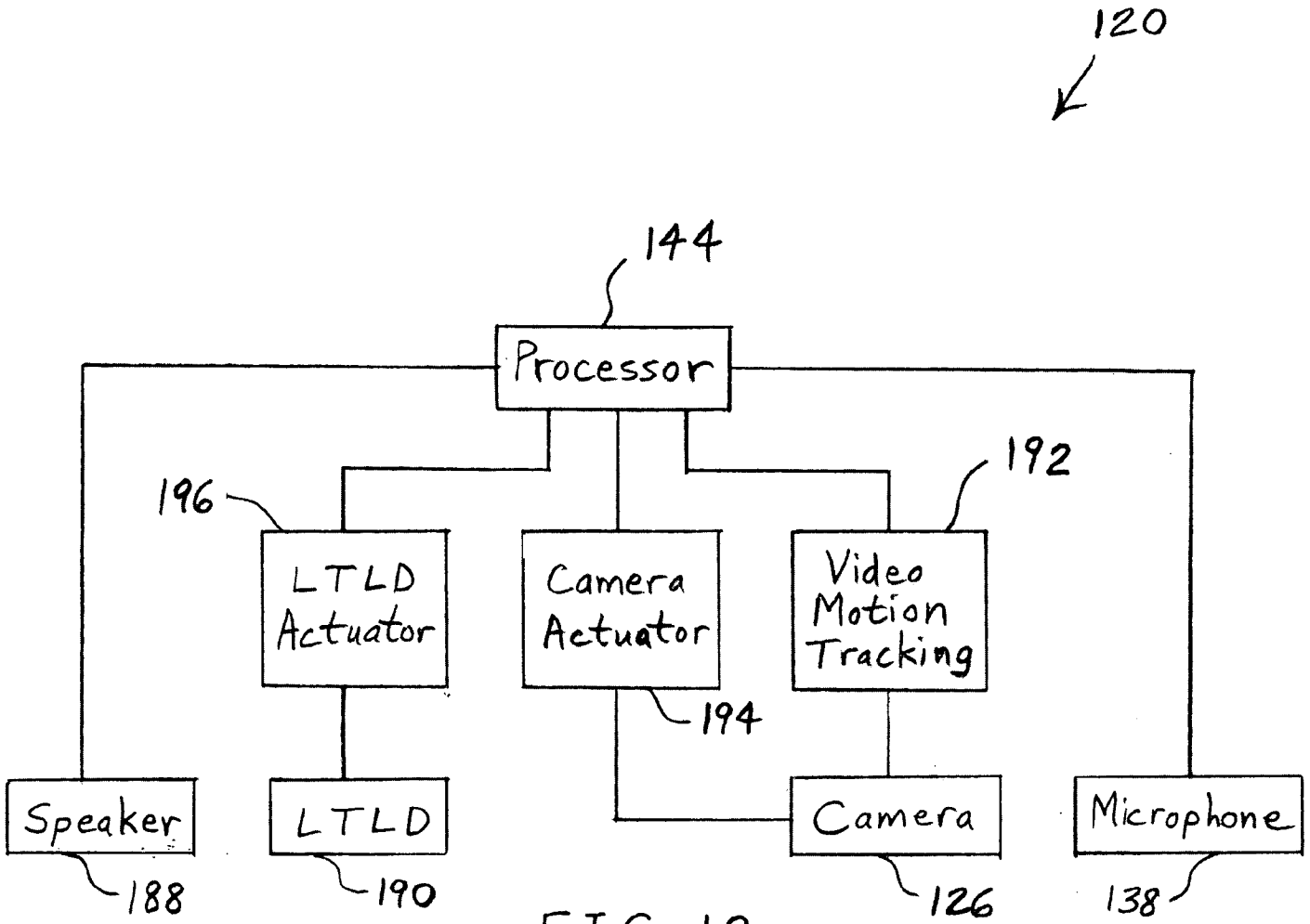
FIG. 12 is a block diagram of the modular building system arrangement of FIG. 11.

Processor 144 of base 124 may collect data from security systems 136*a-c* and camera 126 and may perform some processing and/or control operations. For example, processor 144 may receive quadrant information transmitted by microphones 138 and may use this information to reposition camera 126. As shown in FIG. 12, processor 144 may also receive video motion detection information from a video motion tracking processor 192 which receives and processes images captured by camera 126. Processor 144 may use this video motion detection information to verify an alarm signal from PIR sensors or from microphones 138. Processor 144 may also use this video motion detection information as the primary impetus to produce an alarm signal based upon the detection of a moving object. Further, processor 144 may use this video motion detection information to operate a camera actuator 194, which in turn repositions camera 126 to keep the detected moving object, such as a human intruder, within the camera's field of view.

Processor 144 may use the output signals of microphones 138, video motion tracking processor 192, and/or PIR sensors to determine both that an intruder is present within sensing range and the location of the intruder relative to system 120. Based upon this sensed presence and location of an intruder, processor 144 may operate an LTLD actuator 196, which in turn controls LTLD 190 to direct the deterrent in the direction of the intruder. For example, in the case of a LTLD in the form of pepper spray nozzles 190, LTLD actuator 196 may activate between one and four of eight nozzles 190 that generally point in the direction of the intruder. Processor 144, video motion tracking processor 192 and LTLD actuator 196 may conjointly form an actuator module that controls LTLD 190 in response to a video signal to thereby aim a deterrent substance in the direction of an intruder.

Before activating the LTLD, processor 144 may provide an audible warning to the intruder so that he will be motivated to leave the protected premises. For example, processor 144 may cause a recorded or synthesized voice to be output from speakers 188, wherein the voice may state "Intruder detected. Pepper spray will be activated in five seconds. Please leave the premises," or similar.

Processor 144 may function as a centralized controller for all of security system 120. Processor 144 may communicate audio, video, motion alarms, etc., via internet protocol (IP).

Camera 126 may be positioned in the bottommost position of system 120, as shown in FIG. 11, such that camera 126 is provided with an optimal view that is unimpeded by security systems 136*a-c*. However, it is also possible for a LTLD to be positioned at the bottommost position of system 120 such that the deterrent may be aimed towards the intruder in an optimal direction.

Other features of security system 120 may be substantially similar to those of arrangement 20, and thus are not described in detail herein. In particular, system 120 may include electrical and mechanical connectors that are substantially the same as electrical connectors 48, 74 and mechanical connectors 46, 72 of arrangement 20.

Pepper spray ring 136*c* has been described herein as including multiple nozzles spaced out along its circumference, and selected ones of the nozzles are activated depending on the location of the sensed intruder. In another embodiment (not shown), a LTLD ring has a single output port, and the LTLD ring is rotatable in a 360 degree arc about axis 132 to thereby aim the single output port in the sensed direction of an intruder. The LTLD ring may rotate and stop at a desired position under the control of an LTLD actuator.

In another embodiment, the security system assembly includes PIR motion sensors similar to PIR sensors 40 (FIG. 1). The PIR sensors may provide information regarding the location of a moving object, and this information may be used to point camera 126 as well as to aim and/or activate the LTLD.

Figure 13:
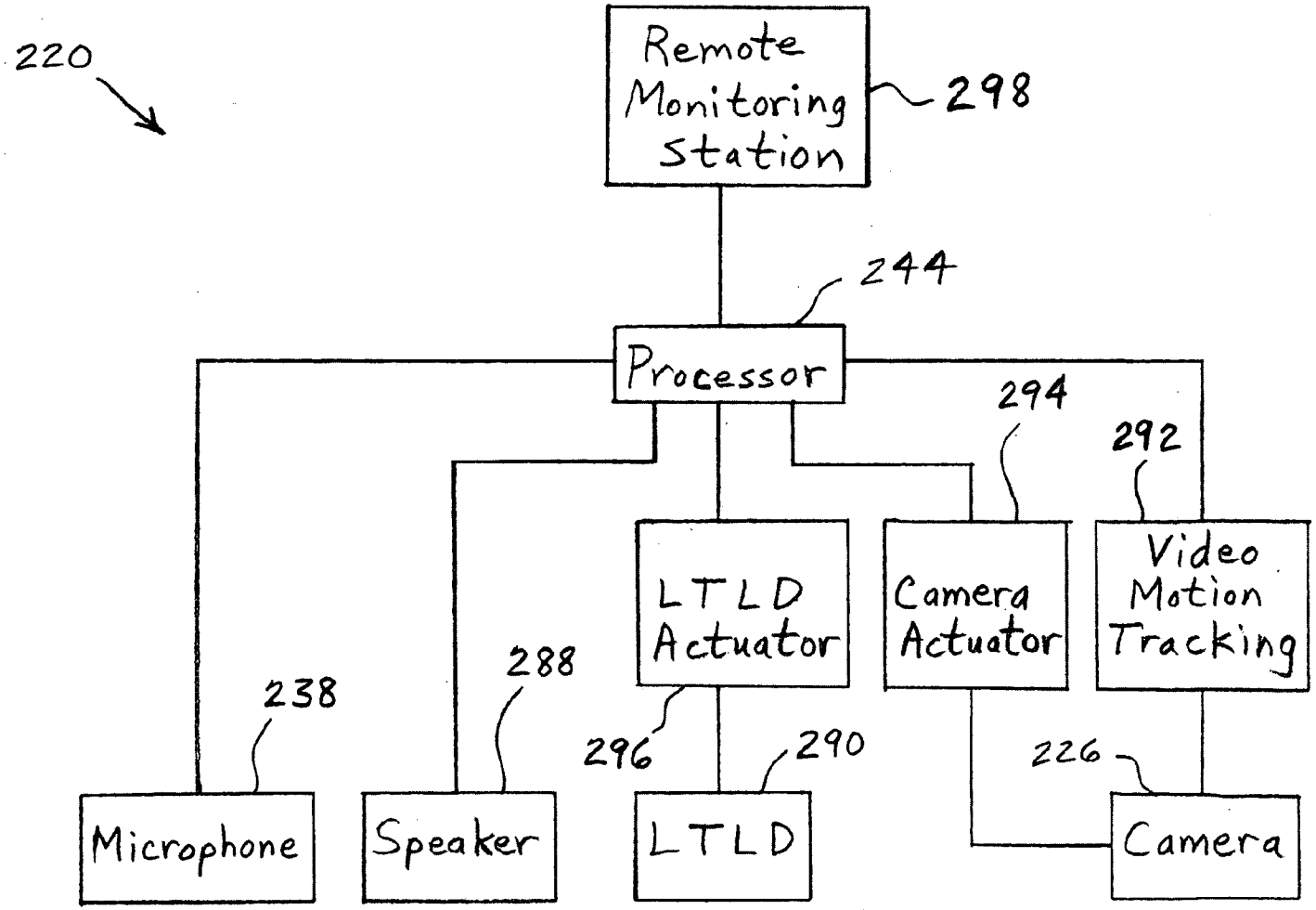
FIG. 13 is a block diagram of another embodiment of a modular building system arrangement of the present invention.

Another embodiment of a modular security system 220 of the present invention is depicted in FIG. 13. System 220 includes camera 226, microphones 238, processor 244, speakers 288, LTLD 290, video motion tracking processor 292, camera actuator 294, and LTLD actuator 296 which may all be substantially similar to their counterparts in system 120. However, in system 220, the outputs of microphones 238 and video motion tracking processor 292 may be forwarded by processor 244 to a remote alarm monitoring station where a human observer may listen to the live outputs of microphones 238 and watch the live images output by video motion tracking processor 292. Instead of, or in addition to, processor 244 running an algorithm to decide how to operate LTLD actuator 296, the human monitor may control via processor 244 the operation of LTLD actuator 296. The human monitor's decisions regarding how to control LTLD actuator 296 may be in response to audio signals based on sounds captured by microphones 238 and/or upon video signals based on images captured by camera 226 transmitted to the remote location of station 298. In one embodiment, the human monitor may override the existing algorithm run by processor 244 to control LTLD actuator 296.

In a particular embodiment, the human monitor of station 298 inhibits the activation of LTLD 290 while the human monitor converses in real time with the human detected in the captured images and/or the captured sounds on the premises. That is, the human monitor may engage in two-way audible communication with the sensed intruder via microphones 238 and speakers 288. The identified intruder may also communicate visually to the human monitor via camera 226. The human monitor may then use his discretion to decide whether the person on the premises is an actual intruder, in which case the human monitor may activate LTLD 290 and summon the police. If, however, the human monitor decides that the person is not an actual intruder, then the human monitor may continue to inhibit the activation of LTLD 290.

Figure 14:
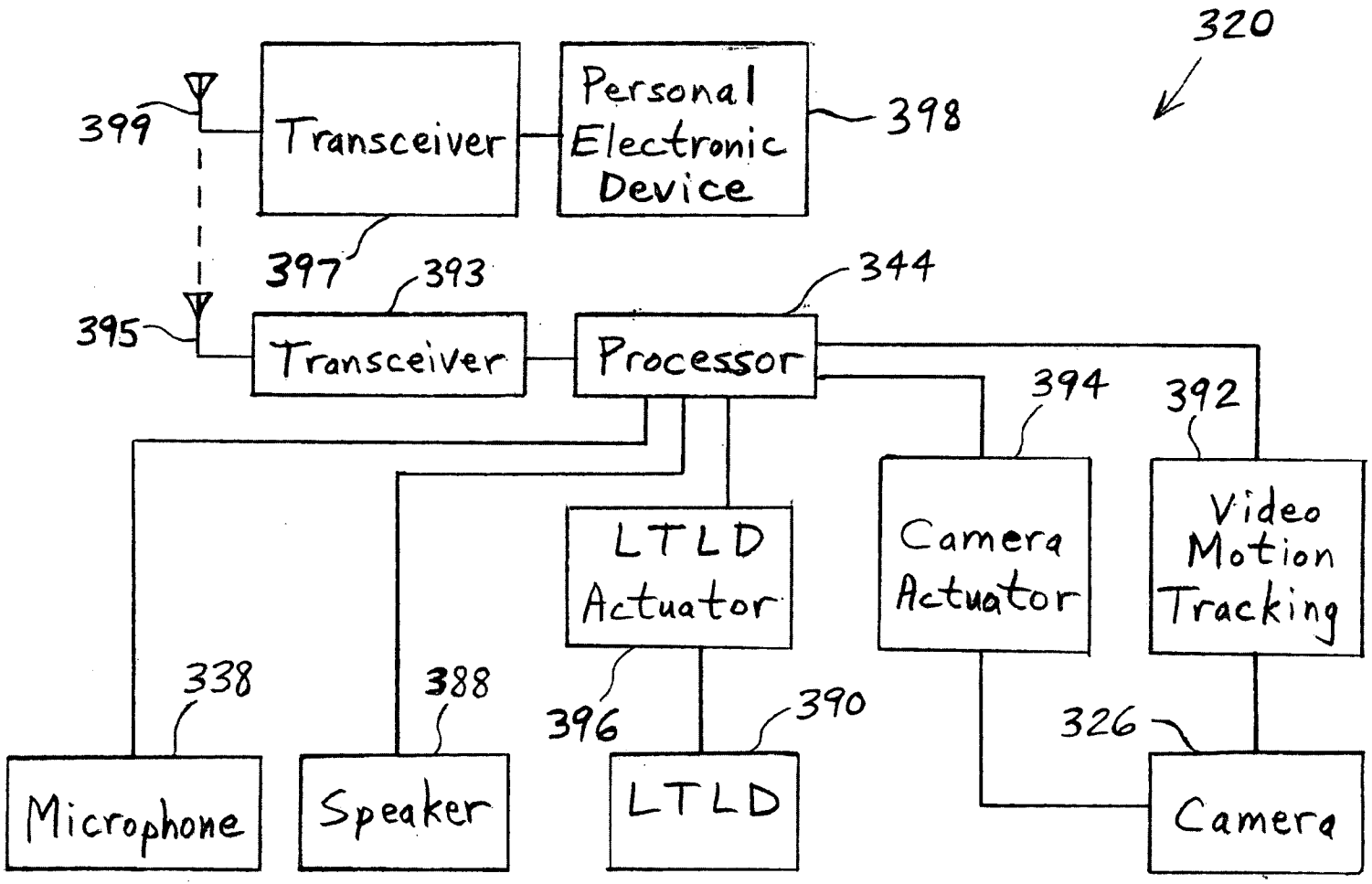
FIG. 14 is a block diagram of yet another embodiment of a modular building system arrangement of the present invention.

Yet another embodiment of a modular security system 320 of the present invention is depicted in FIG. 14. System 320 includes camera 326, microphones 338, processor 344, speakers 388, LTLD 390, video motion tracking processor 392, camera actuator 394, and LTLD actuator 396 which may all be substantially similar to their counterparts in systems 120 and 220. However, in system 320, the outputs of microphones 338 and video motion tracking processor 392 may be forwarded by processor 344 to a remote personal electronic device 398 such as a mobile telephone/email device or personal data assistant, for example. More particularly, processor 344 may be in communication with a transceiver 393 having an antenna 395 that transmits via radio frequency the outputs of microphones 338 as well as video signals from video motion tracking processor 392. Personal electronic device 398 may include a transceiver 397 having an antenna 399 for receiving the transmitted outputs of microphones 338 and video motion tracking processor 392. A human user of personal electronic device 398, who may be a resident of the premises that are secured by system 320, may listen to the live outputs of microphones 338 and watch the live images output by video motion tracking processor 392. Instead of, or in addition to, processor 344 running an algorithm to decide how to operate LTLD actuator 396, the human user may control via processor 344 the operation of LTLD actuator 396. The human user's decisions regarding how to control LTLD actuator 396 may be in response to radio frequency audio signals based on sounds captured by microphones 338 and/or upon RF video signals based on images captured by camera 326 transmitted to the remote location of the human user. In one embodiment, the human user may override the existing algorithm run by processor 344 to control LTLD actuator 396.

If the human user desires that LTLD 390 be activated, he may enter a numeric code into electronic device 398 to thereby cause a radio frequency deterrent activation signal to be transmitted to processor 344 via transceivers 397, 393. Processor 344 may respond to the deterrent activation signal by causing LTLD actuator 396 to immediately activate LTLD 390.

In a particular embodiment, the human user of electronic device 398 inhibits the activation of LTLD 390 while the human user converses in real time with the human sensed on the premises. That is, the human user may engage in two-way audible communication with the sensed intruder via microphones 338 and speakers 388. The identified intruder may also communicate visually to the human user via camera 326. The human user may then use his discretion to decide whether the person on the premises is an actual intruder, in which case the human user may activate LTLD 390 and summon the police. If, however, the human user decides that the person is not an actual intruder, then the human user may continue to inhibit the activation of LTLD 290.

Figure 15:
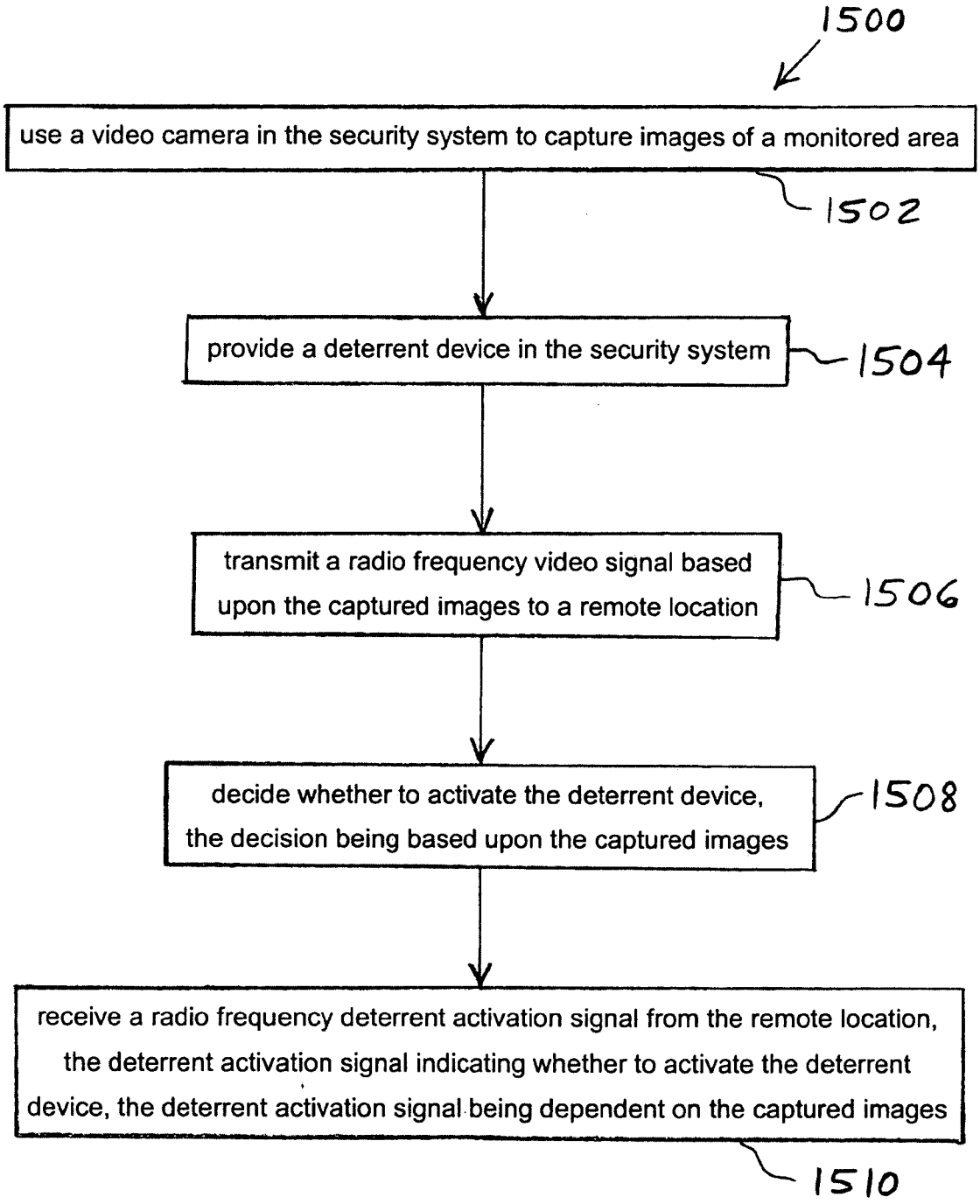
FIG. 15 is a flow chart of one embodiment of a method of the present invention for operating a security system.

One embodiment of a method 1500 for operating a security system is shown in FIG. 15. In a first step 1502, a video camera in the security system is used to capture images of a monitored area. For example, video camera 326 in security system 320 may be used to capture images of a monitored area surrounding system 320. Camera 326 may be rotatable about a vertical axis in a 360 degree arc and may be tiltable in vertical directions relative to a horizontal direction while capturing the images.

In a next step 1504, a deterrent device in provided in the security system. In security system 320, a less than lethal deterrent device 390 is provided. LTLD 390 may be in the form of pepper spray ring 136*c* (FIG. 11), an audio speaker ring 136*b* that produces high output sound pressure, a tazer gun, a smoke screen generator, high intensity light or flashes, tear gas, or a fluorescent dye, for example.

Next, in step 1506, a radio frequency video signal based upon the captured images is transmitted to a remote location. In the embodiment of FIG. 14, video motion tracking processor 392 may produce a video signal based on images captured by camera 326, and processor 344 may direct the video signal to transceiver 393 for RF transmission to the remote location at which personal electronic device 398 is disposed.

In step 1508, it is decided whether to activate the deterrent device. The decision may be based upon the captured images. For example, a human user of personal electronic device 398 may view images on a display screen of device 398, wherein the images are created from the video signal received from transceiver 393. The human user may evaluate whether the images are of an intruder or someone who is authorized to be on the premises monitored by system 320. If the human user believes it is an intruder he is seeing, then he may decide to activate LTLD 390. Conversely, if the human user believes he is seeing someone who is authorized to be on the monitored premises, then he may decide not to activate LTLD 390.

In a final step 1510, a radio frequency deterrent activation signal is received from the remote location. The deterrent activation signal indicates whether to activate the deterrent device and is dependent on the captured images. That is, the human user may key in a numeric code via pushbuttons of a remote personal electronic device 398, which may cause transceiver 397 to transmit an RF deterrent activation signal. The signal is then received by processor 344 via transceiver 393. Depending upon the particular numeric code that is entered after the human user has viewed the captured images and has made his decision based thereon regarding the presence of an intruder, the deterrent activation signal may indicate that the deterrent device should be activated, or may indicate that the deterrent device should not be activated.

While this invention has been described as having an exemplary design, the present invention may be further modified within the spirit and scope of this disclosure. This application is therefore intended to cover any variations, uses, or adaptations of the invention using its general principles.

What is claimed is:

1. A security system, comprising:

an enclosure;

a video system disposed in the enclosure and configured to obtain images of an intruder;

a deterrent dispensing device disposed in the enclosure and configured to dispense a deterrent substance in a selected direction; and an actuator module disposed in the enclosure and communicatively coupled to the video system and coupled to the deterrent dispensing device, the actuator module being configured to receive a video signal from the video system and, in response thereto, control the deterrent dispensing device, wherein the deterrent dispensing device includes multiple nozzles, and the outputting of a deterrent substance from the deterrent dispensing device in a selected direction based on a location of a moving object includes selecting a subset of the multiple nozzles.

2. The system of claim 1 further comprising a two-way audio device disposed in the enclosure and configured to warn the intruder before the deterrent substance is dispensed.

3. The system of claim 1 wherein the actuator module includes a processor configured to analyze the video signal to thereby detect motion of the intruder.

4. The system of claim 1 further comprising a passive infrared motion detector disposed in the enclosure, the actuator module being configured to control the deterrent dispensing device dependent upon an output signal of the passive infrared motion detector.

5. The system of claim 1 wherein the actuator module includes a radio frequency transmitter configured to receive the video signal from the video system and transmit the video signal to a remote location.

6. The system of claim 5 wherein the actuator module includes a radio frequency receiver configured to receive a radio frequency deterrent dispensing signal from the remote location, the deterrent dispensing signal indicating whether to dispense the deterrent substance from the deterrent dispensing device, the deterrent dispensing signal being dependent on the captured images.

7. The system of claim 6 wherein the deterrent dispensing signal from the remote location comprises a numeric code transmitted from a personal electronic device that receives the video signal.

8. The system of claim 1, wherein the actuator module is configured to use the video signal to aim the dispensed deterrent substance in the direction of the intruder.

9. The system of claim 1, wherein the actuator module is configured to use the video signal to aim the dispensed deterrent substance based on a location of the intruder as determined by the video system.

10. The system of claim 1, wherein the actuator module is configured to aim the dispensed deterrent substance by use of target local information provided by camera video motion sensing.

11. The system of claim 1, wherein the actuator module is configured to rotate the deterrent dispensing device about a vertical axis and stop the rotation at a desired position to thereby aim the dispensed deterrent substance in a direction of the intruder.

12. A method of operating a security system, comprising the steps of:

capturing sounds within a monitored area with a plurality of microphones disposed in an enclosure;

determining a location of a moving object within the monitored area based upon the captured sounds;

providing a deterrent dispensing device in the enclosure;

deciding whether to activate the deterrent dispensing device; and outputting a deterrent substance from the deterrent dispensing device in a direction that is based on the location of the moving object as determined from the captured sounds, wherein the deterrent dispensing device includes multiple nozzles, and the outputting of a deterrent substance from the deterrent dispensing device in a direction based on a location of a moving object includes selecting a subset of the multiple nozzles to output a deterrent substance.

13. The method of claim 12 wherein the deciding whether to activate the deterrent dispensing device is performed automatically by a processor.

14. The method of claim 12 wherein the deciding whether to activate the deterrent dispensing device is performed by a human at a location remote from the security system.

15. The method of claim 12 wherein the outputting of a deterrent substance from the deterrent dispensing device in a direction that is based on the location of the moving object includes rotating the deterrent dispensing device about a vertical axis and stopping the rotation at a desired position.

16. The method of claim 12, including:

using a plurality of passive infrared motion sensors to provide information regarding a location of a moving object within the monitored area, wherein the passive infrared motion sensors are located in the enclosure with the plurality of microphones, and wherein the step of deciding whether to activate the deterrent dispensing device is based on the information from the passive infrared motion sensors.

* * * * *